United States Patent [19]

Scott et al.

[11] 4,315,069

[45] Feb. 9, 1982

[54] COLOR COUPLER COMBINATION

[75] Inventors: John G. V. Scott, Maldon; Anthony K. Harvey, Stisted, Nr. Braintree, both, England

[73] Assignee: Ciba Geigy AG, Basel, Switzerland

[21] Appl. No.: 186,098

[22] Filed: Sep. 11, 1980

[30] Foreign Application Priority Data

Sep. 18, 1979 [GB] United Kingdom ..... 32291/79

[51] Int. Cl.[3] ..... G03C 7/00; G03C 1/40

[52] U.S. Cl. ..... 430/365; 430/382; 430/384; 430/385; 430/386; 430/388; 430/389; 430/505; 430/544; 430/549; 430/552; 430/553; 430/554; 430/556; 430/557

[58] Field of Search ..... 430/365, 549, 552, 553, 430/554, 555, 556, 505, 382, 384, 385, 386, 388, 389, 544

[56] References Cited

U.S. PATENT DOCUMENTS

| | | | |
|---|---|---|---|
| 2,592,514 | 4/1952 | Harsh | 430/549 |
| 2,628,902 | 2/1953 | Raibourn | 430/365 |
| 2,689,180 | 9/1954 | Friedman | 430/365 |
| 2,994,610 | 8/1961 | Maus | 430/365 |
| 3,632,373 | 1/1972 | O'Connell et al. | 430/549 |

FOREIGN PATENT DOCUMENTS

| | | | |
|---|---|---|---|
| 2160971 | 8/1972 | Fed. Rep. of Germany | 430/549 |

*Primary Examiner*—J. Travis Brown

*Attorney, Agent, or Firm*—Sprung, Felfe, Horn, Lynch & Kramer

[57] ABSTRACT

Color photographic material is described in which a yellowish image is formed which can be used to print black and white prints. Also present in the layer is a small amount of a more reactive coupler which produces a colored image to which black and white paper is not sensitive. This more reactive coupler reduces the fog in the highlight areas.

Most preferably small amounts of other couplers are present which result in a green or brown image which makes it easier for the operator to focus the image.

31 Claims, No Drawings

COLOR COUPLER COMBINATION

This invention relates to the production of monochromatic dye images using silver halide photographic material.

In normal colour photography it is usual to produce three colour images by an imagewise exposure and colour development of colour photographic material, there being in at least one layer a cyan image, in at least one layer a yellow image and in at least one layer a magenta image. These images when viewed together in the colour tripack combine to form either a positive colour reproduction of the original or a negative colour reproduction of the original which can be used to produce a positive colour reproduction of the original, depending on the colour photographic material used. However, other colour photographic material is known, the object of which, after colour development, is to produce a monochromatic reproduction of the original, that is to say a single dye image of the original like a silver image, rather than the composite three dye image produced in colour photographic material.

The object of forming a monochromatic dye image rather than a silver image is to produce an almost grainless image which can be used for enlarging purposes. There is also the added advantage that all the silver present in the silver halide material which is exposed can be recovered as none is present in the processed material.

Photographic material which yielded a monochromatic image was described in 1938 in B.P. specifications Nos. 490 517 and 492 518. In both these specifications the invention lay in the production of black or at least dark grey monochromatic dye images which could be used for enlarging purposes. However normal silver halide photographic enlarging paper is not fully colour sensitized and thus is sensitive only to blue-green light so that it can be used under yellow safelight conditions. Thus in monochromatic material of use for enlargement purposes it is required only that a yellow-orange image be produced as this image will absorb blue-green light. Nevertheless it is often desirable to produce in conjunction with the yellow-orange image another dye image to form an image which is easier for the operator to see and use for picture composing and focussing in darkroom conditions. Such a composite image formed from two or more dyes in the same layer is called in this specification a monochromatic image to distinguish it from the tri-colour image formed in colour photographic material.

In spite of the obvious attractions of using a virtually grain-free monochromatic dye image to produce enlargements and also the concomitant advantage of full silver recovery very little commercial use has been made of the process. This is probably because colour development is more active than normal silver halide development and results in an undesirable high fog level being produced in the monochromatic image material. This results in degraded high density areas in the final print.

It is the object of the present invention to provide silver halide photographic material containing colour couplers and which yields a monochromatic dye-image when colour developed and silver image bleached but by use of which the effect of the high activity of colour development is minimized.

According to the present invention there is provided photographic silver halide material for preparing a monochromatic dye-image by a chromogenic process which material comprises in at least one silver halide emulsion layer a colour coupler which couples with oxidized colour developer of aromatic primary amino type to produce a yellowish dye which absorbs light in the region of from 350 to 560 nm, a more reactive (as hereinafter defined) coupler compound which reacts with oxidized colour developer of the primary amino type to yield a dye of which the absorption is predominantly above 560 nm, and optionally further colour couplers, the ratio of coupler which produces a yellowish dye to more reactive coupler being from 10:0.1 to 10:2.0, the parts being by weight.

According to another object of the present invention there is provided a process for the preparation of a monochromatic dye image by use of the inventive photographic material.

By a dye the absorption of which is predominantly above 560 nm is meant that at least 90% of the absorption is above 560 nm. Usually a reactive coupler is chosen which couples to produce a dye the absorption of which is all above 560 nm, but it is sometimes desirable, in order to increase the density of the image, that some of the absorption is below 560 nm.

The term "more reactive coupler" as used hereinafter means a coupler which couples more readily with oxidized colour developer than the yellow couplers also present in the same layer and which produces a dye which absorbs above 560 mm. A treat to illustrate comparative reactivities of coupler compounds is set forth hereinafter.

Most preferably the more reactive coupler is an active cyan colour coupler. The reation product of a cyan colour coupler and oxidized colour developer is a dye which absorbs in the region of from 620 to 690 nm, i.e. above 560 nm.

Because it is difficult for an operator making photographic enlargements to bring into focus a film having only a yellow image it is preferred that there is present in the silver halide emulsion layer which comprises the yellowish colour coupler and the more reactive coupler compound a further amount of a coupler or a mixture of couplers which produce with the yellowish coupler either a green image or most preferably a brown image. Thus there may be present additionally a cyan colour coupler which is either no more reactive than the yellowish colour coupler or is less reactive. When such a cyan coupler is present the preferred ratios of the three coupler compounds are 10 parts yellowish colour coupler, from 2 to 4 parts cyan coupler and from 0.1 to 2.0 parts more reactive coupler compound. This produces a green final image. In order to produce a brown final image it is necessary to have present in the silver halide emulsion layer which comprises said three couplers a magenta coupler as well. This magenta coupler should be either less reactive or no more reactive than the yellowish coupler. When such a magenta coupler is present the preferred ratios of the four coupler compounds are 10 parts yellowish colour coupler, from 2 to 4 parts magenta colour coupler, from 2 to 4 parts cyan colour coupler and from 0.1 to 2.0 parts more reactive coupler compound. Most preferably in this case the more reactive coupler compound is also a cyan colour coupler.

In a preferred embodiment there is also present in the layer which comprises the yellowish colour coupler, the magenta colour coupler, the cyan colour coupler and the more reactive coupler compound a so-called DIR coupler. That is to say a coupler compound which reacts with oxidized colour developer to release a development inhibitor (DI) compound. Preferably the DIR coupler is a colour coupler and most preferably a yellow DIR colour coupler.

Examples of DIR colour couplers are given in British patent specifications Nos. 980 507 and 1 250 318.

Preferably only a small amount of DIR coupler is present in the silver halide emulsion layer which comprises the other colour couplers and the more reactive coupler compound.

Thus a preferred silver halide photographic material comprises in at least one silver halide emulsion layer 10 parts yellowish colour coupler, 2 to 4 parts less reactive cyan colour coupler 2 to 4 parts magenta colour coupler, 0.5 to 1.5 parts more active cyan colour coupler and 0.1 to 1.0, or preferably 0.1 to 0.4 parts yellow DIR colour coupler.

The preferred silver halide photographic material has a silver coating weight of from 4 to 5 $g/m^2$ and a yellowish colour coupler coating weight of from 1.0 to 2.5 $g/m^2$.

According to another aspect of the present invention there is provided a process for the preparation of a monochromatic dye image which comprises imagewise exposing the photographic silver halide material containing in at least one silver halide emulsion layer a yellowish colour coupler and a small amount of a more reactive coupler as hereinbefore defined, colour developing the exposed material using a colour developing solution which comprises an aromatic primary amino colour developing agent, bleaching the thus formed silver image to yield a monochromatic dye image. Preferably the aromatic primary amino colour developing agent is a para-phenylenediamine colour developing agent.

During this process in the areas of very low exposure or no exposure only small amounts of oxidized developer will be produced and most of this will be due to fog, that is to say latent image caused by factors other than imagewise exposure. In such areas the colour couplers will compete for such oxidized developer as has been produced and the most reactive colour coupler will take the major share of this colour developer. Thus when the photographic material used in the process is of the preferred type, that is to say when the more reactive coupler is a cyan coupler, the fog region becomes cyan. As cyan does not absorb blue light it is in effect invisible to the printing paper used to prepare prints from a negative prepared by the process of the present invention. However the inclusion of too much active cyan colour coupler in the silver halide emulsion layer of the photographic material causes an unacceptable loss of speed as it will compete with the yellowish colour coupler in the areas in which a yellow image should be formed.

However preferably as hereinbefore stated, there is also present in the silver halide emulsion layer a lesser amount, compared with the amount of yellowish colour coupler, of a less reactive cyan coupler and a magenta colour coupler. These couplers will compete with the yellowish colour coupler and a brown dye image will be formed in the imagewise exposed areas. As stated the photograhic silver halide printing paper 'sees' only the blue absorbing component (yellowish dye) of the brown image. The red absorbing components (cyan dye and magenta dye) of the brown image are formed to provide greater visual contrast of the dye image in the negative to enable the user to focus the image more easily on to the printing paper.

Also as stated in the silver halide emulsion layer of the photographic material there is preferably present a small amount of DIR coupler. In the process of the present invention the presence of the more reactive coupler minimizes the release of DI compound in the fog region. However DI compound is released from the DIR coupler in areas of higher exposure. This results in a more contrasty image in the low exposure regions and an increase in edge effect in high exposure regions where maximum compensation for sharpness loss due to scatter is required.

Thus in the material produced by the process of the present invention when using the most preferred photographic material of the present invention the yellowish colour coupler, magenta colour coupler and the yellow DIR coupler all contribute to the yellow-orange component of the brown dye image which is visible to printing paper whilst the more reactive cyan coupler and the less reactive cyan coupler both contribute to the cyan component of the brown dye image, whilst a predominantly cyan dye image is formed in the fog region.

In one embodiment of the photographic material of the present invention the photographic material comprises two silver halide emulsion layers, each layer comprising a yellowish colour coupler and a more reactive coupler, however on processing a similar monochromatic image is formed in each silver halide emulsion layer. Preferably each silver halide emulsion layer contains the same mixture of the five types of colour coupler as hereinbefore set forth. Most preferably however the silver halide/coupler ratio of the silver halide present in the two layers is different. Also the photographic speed of each layer is different.

Thus the top layer in the assembly contains a high speed silver halide emulsion and the lower layer a low speed silver halide emulsion. This combination gives extended sensitivity to the total assembly so that subjects with an extended luminence range can be satisfactorily reproduced, and good overexposure latitude is achieved. The silver halide/coupler ratio in the two layers is preferably different. In the high speed layer the ratio is higher than in the lower speed layer. The high ratio gives low granularity in the high speed layer, and the low ratio gives good tone reproduction in the low speed layer where granularity is less important.

Preferably in the photographic material of the present invention the or both silver halide layers are optically sensitized by means of optical sensitizing dyes and most preferably the or both silver halide layers are panchromatically sensitized, that is to say have a sensitivity from 400 to 700 nm, the whole useful range of the visible spectrum.

Preferably the yellowish colour coupler of use in the photographic material is a pivalyl acetanilide or benzoyl acetanilide yellow coupler.

Pivalyl acetanilide yellow colour couplers are described for example in British Pat. No. 1 078 338.

Benzoyl acetanilide yellow colour couplers are described for example in U.S. Pat. No. 2,407,210.

A suitable pivalyl acetanilide yellow colour coupler has the general formula

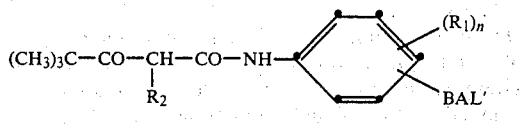

wherein $R_1$ is a substituent and n is 0, 1 or 2, $R_2$ is hydrogen or a leaving group (including a DI group) and BAL' represents a ballasting group to make the coupler substantive to the layer in which it was coated.

The ballasting group is e.g. a 2,4-dialkyl-phenoxy radical attached to a —NHCO—$(CH_2)_m$—group, wherein the alkyl groups have at least 5 carbon atoms and m is an integer of from 1 to 5.

Preferably n is 1 and $R_1$ is lower alkyl or alkoxy having 1 to 4 carbon atoms or chlorine or bromine.

Most preferably $R_1$ is chlorine.

Examples of suitable yellow couplers of formula (1) are given in U.S. Pat. No. 3,265,506 and U.S. Pat No. 3,384,657.

A suitable benzoyl acetanilide yellow colour coupler has the general formula

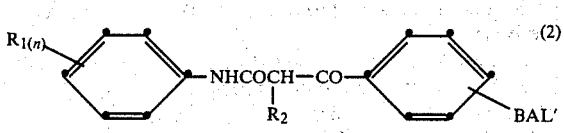

wherein $R_1$, n, $R_2$ and BAL' have the meanings assigned to them above.

Suitable DIR couplers have the general formulae

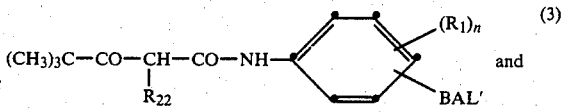

and

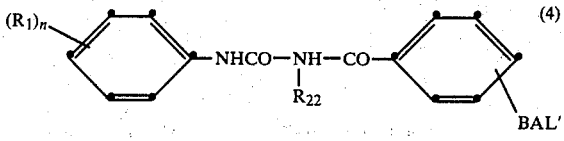

wherein $R_1$, n and BAL' have the meanings assigned to them above and $R_{22}$ is a DI compound, e.g. an alkylthiotriazole, mercapto, mercaptotetrazole or benztriazole group. Examples of useful DI compounds which may be present are (a) alkylthiotriazoles of the general formula

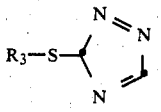

wherein $R_3$ is alkyl from 4 to 8 carbon atoms such as pentyl, hexyl or heptyl (as described in British Pat. No. 1 520 880), (b) groups of the general formula —S—$R_4$, wherein $R_4$ is alkyl having 4 to 8, preferably 5 or 6 carbon atoms, or aryl e.g. phenyl or naphthyl (as described in British Pat. No. 953 454), (c) 1-phenyl-5-mercaptotetrazole which has the formula

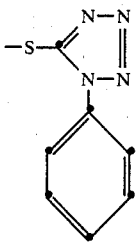

and (d) 1,2,3-benztriazolyl groups of the general formula

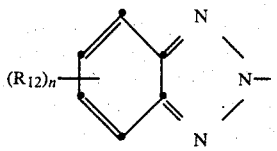

wherein $R_{12}$ represents optional substitution and n is 1 to 3. Compounds of this type are described in British Pat. No. 1 250 318.

Preferably $R_{12}$ is hydrogen or alkyl having 1 to 4 carbon atoms.

In a preferred embodiment of the photographic material of the present invention the yellow colour coupler in the/each silver halide emulsion layer is a pivalyl coupler of formula (1) wherein $R_2$ is hydrogen and the DIR coupler is also the pivalyl coupler of formula (3), wherein $R_{22}$ is either an alkylthiotriazole of formula (5) or 1-phenyl-5-mercaptotetrazole.

Particularly suitable reactive cyan couplers of use in the photographic material of the present invention are naphthol cyan colour couplers of the general formula

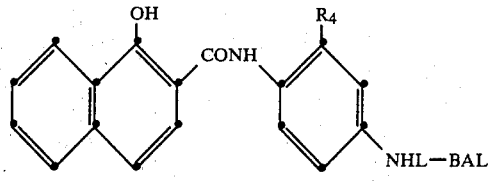

wherein $R_4$ is hydrogen, halogen or alkoxy, K is a linking group and BAL represents a ballasting group.

In the meaning of halogen, $R_4$ is preferably chlorine or bromine. Suitable alkoxy groupings $R_4$ are methoxy and ethoxy. Preferred linking groups L are of the formula —$COCHR_{12}$—, wherein $R_{12}$ is hydrogen or lower alkyl. The ballasting group is preferably a dialkyl phenoxy radical wherein the alkyl groups contain at least 5 carbon atoms.

Examples of naphthol cyan colour couplers of formula (6) are given in British Pat. 1 543 040.

Examples of useful less reactive cyan couplers for use in the photographic material of the present invention are given for example in German Pat. No. 1 137 311.

However the preferred less reactive cyan couplers are those which on coupling yield a dye whose maximum absorption is below 700 nm. Thus preferably a phenolic cyan colour coupler and not a naphthoic colour coupler is used.

A useful class of phenolic cyan colour couplers for this purpose are those of the general formula

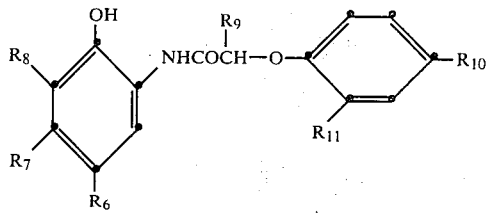

(9)

wherein $R_6$ is hydrogen or halogen, $R_7$ and $R_8$ are each hydrogen, halogen or alkyl having from 1 to 4 carbon atoms, $R_9$ is hydrogen or alkyl having from 1 to 4 carbon atoms and $R_{10}$ and $R_{11}$ are each alkyl having from 5 to 10 carbon atoms.

In the meaning of halogen, $R_6$ is preferably chlorine or bromine. Preferred alkyl groups for $R_7$, $R_8$ and $R_9$ are methyl, ethyl, propyl and butyl. Suitable alkyl groups for $R_{10}$ and $R_{11}$ are phenyl, hexyl, heptyl, octyl, nonyl, decyl and the corresponding isomers.

A large number of magenta colour couplers are of use in the photographic material of the present invention. Exemplary of such magenta colour couplers are those described in U.S. Pat. No. 2,908,573 and British patent specifications Nos. 680 488 and 1 129 333.

Particularly suitable magenta colour couplers are those described in British patent specification No. 865 721 which are of the general formula

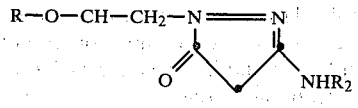

(10)

wherein R is hydrogen or a carboxylic acyl group R'—CO—, wherein R' is alkyl having 1 to 4 carbon atoms, $R_2$ is a carboxylic acyl group R'—CO— and $R_3$ is hydrogen, alkyl having 1 to 4 carbon atoms, phenyl or substituted phenyl.

Preferably R' is methyl or ethyl. If $R_3$ is alkyl having 1 to 4 carbon atoms, methyl, ethyl and butyl are preferred. If $R_3$ denotes substituted phenyl, the substituents on the phenyl group are chlorine, methoxy, deoxy or methyl.

Preferably all the colour couplers are present in the silver halide emulsion layer (or layers) as an oil dispersion. The couplers may be prepared and added in a single oil dispersion or may be added as separate oil dispersions.

The photographic material of the present invention may be coated on any of the usual transparent film bases including cellulose triacetate, cellulose acetate-butyrate and subbed and oriented polyethylene terephthalate.

Preferably the silver halide used is an iodobromide silver halide having a halide ratio of from 1.5 to 10% of iodide to bromide.

Preferably the silver halide is panchromatically sensitized using both at least one green optical sensitizing dye and at least one red optical sensitizing dye.

The silver halide emulsion may be chemically sensitized by sulphur and/or gold sensitizers and also by polyethylene oxide compounds or by other chemical sensitizing agents used to sensitize high speed camera film emulsions.

The silver halide emulsion may be stabilized by the presence of stabilizing compounds used to stabilize such emulsions, such as tetrazindene compounds and mercaptotriazole compounds.

The binder for the silver halide crystals in the silver halide emulsion is preferably gelatin but so-called gelatin extenders may be present such as acrylamides and polyvinyl alcohol. Latex polymers may also be present such as latex polymers derived from alkyl acrylates and methacrylates.

The binder may be hardened using any of the well known hydrophilic colloid binders such as formaldehyde, glyoxal and triazine derivatives.

The accompanying Example will serve to illustrate the invention.

EXAMPLE

Couplers used:

(I) yellow coupler

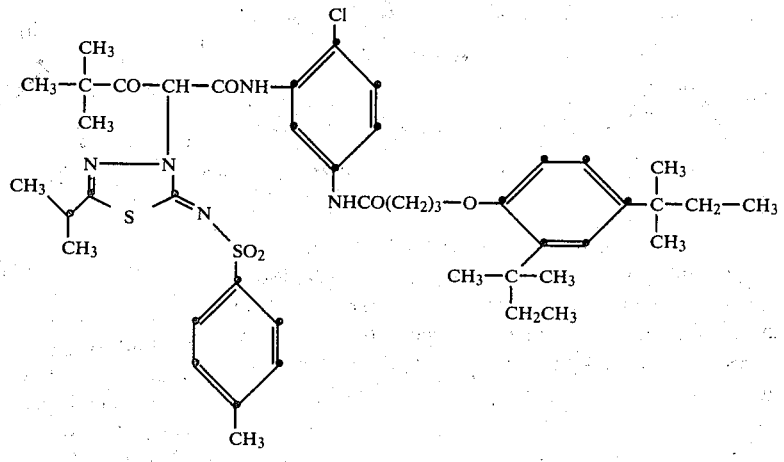

5-{γ-[2,4-Bis(1,1-dimethylpropyl)phenoxy]-butyramido}-2-chloro-α-[5-isopropyl-2-(4-tolylsulphonylimino)-$\Delta^4$-1,3,4-thiadiazolin-3-yl]-α-pivalylacetanilide (II) magenta coupler

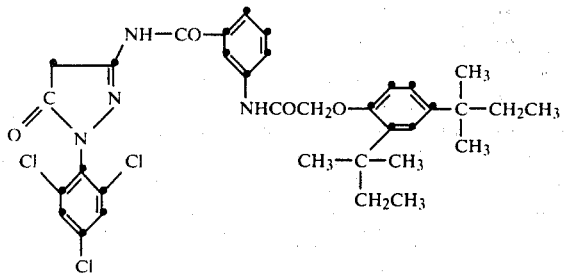

3-{3-[(2,4-Bis[1,1-dimethylpropyl]phenoxy)acetamido]-benzamido}-1-(2,4,6-trichlorophenyl)-2-pyrazolin-5-one (III) active cyan coupler

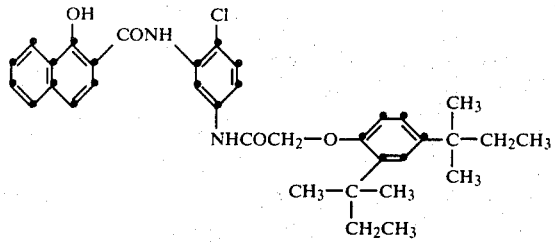

2-{5-[(2,4-Bis(1,1-dimethylpropyl)phenoxy)acetamido]-2-chlorophenylcarbamoyl}-1-naphthol (IV) less reactive cyan coupler

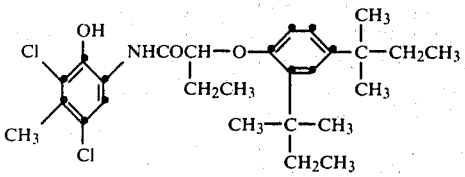

6-{α-[2,4-Bis-(1,1-dimethylpropyl)phenoxy]-butyramido}-2,4-dichloro-3-methylphenol (V) yellow DIR coupler

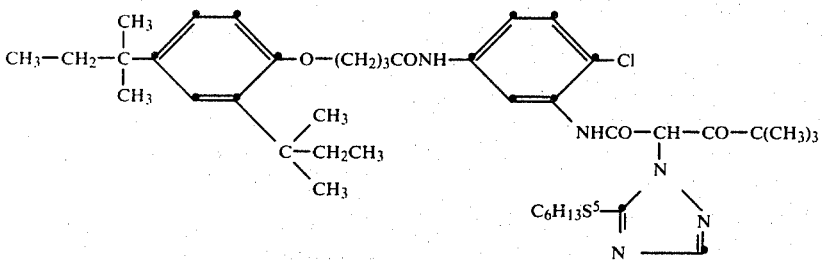

5-{γ-[2,4-Bis(1,1-dimethylpropyl)phenoxy]-butyramido}-2-chloro-α-(3-hexylthio-1,2,4-triazol-1-yl)-α-pivalylacetanilide Coupler (V) may also be written as the isomeric species:

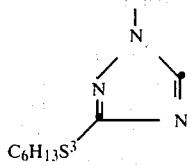

(VI) cyan coupler

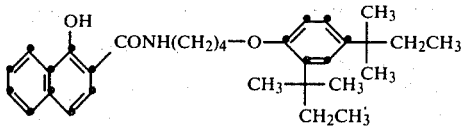

2-{4-[2,4-Bis(1,1-dimethylpropyl)phenoxy]butylcarbamoyl}-1-naphthol

The silver halide emulsion used is panchromatically sensitized by use of 0.15 mg of the dye of the following formula which has a peak sensitivity at 580–620 nm.

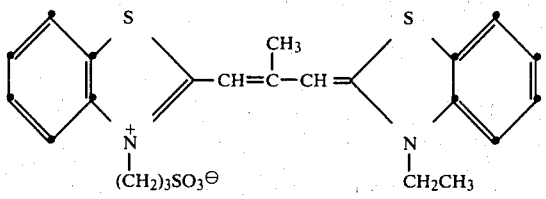

Anhydro-(3-ethyl-2-benzothiazole)[3-(3-sulphopropyl)-2-benzothiazole]-β-methyltrimethincyanine hydroxide

EXAMPLE 1

A panchromatically sensitized silver halide emulsion which contains 70 mg of gelatin and 70 mg of silver is combined with 26.4 mg of yellow coupler (I), 8.8 mg of magenta coupler (II), 2.2 mg of active cyan coupler (III), 6.6 mg of less reactive cyan coupler (IV) and 1.2 mg of yellow DIR coupler (V). The couplers are added as an oil dispersion which comprises:

| | |
|---|---|
| Total coupler | 10 g |
| Tri-isopropyl phenyl phosphate | 7.5 g |
| Gelatin | 4 g |
| Ethyl acetate | 5 g |
| Sodium alkyl naphthalene sulphonate | 10 ml |
| Nonyl phenol ethylene oxide condensate | 0.5 g |
| Water to | 100 g |

The mixture is dispersed by colloid mill.

The dispersion is added to aqueous emulsion with hand stirring at 40° C. The mixture is coated onto a cellulose acetate base in a conventional manner and, after it has solidified, dried. The quantity data are based on 1 $dm^2$ of base area.

This assembly (assembly A) is coated with a protective gelatin non stress layer.

A second assembly (assembly B) is prepared as above except that 2.2 mg of active cyan coupler (III) is replaced by 2.2 mg of less reactive cyan coupler (IV).

After exposing the material behind a continuous wedge it is treated as follows at 37.8° C.:

| | | |
|---|---|---|
| 1. | Colour developing | 3 ¼ minutes |
| | developer bath: | |
| | potassium carbonate | 37.5 g |
| | sodium metabisulphite (anhydrous) | 4.25 g |
| | potassium iodide | 2.0 mg |
| | sodium bromide | 1.3 g |
| | Hydroxylamine sulfate | 2.0 g |
| | 4-(N-ethyl-N-β-hydroxyethylamino)-2-methylaniline sulphate | 4.75 g |
| | Water to make up to | 1 liter |
| 2. | Bleaching | 6 ½ minutes |
| | bleaching bath: | |
| | ammonium bromide | 150 g |
| | ammonium salt of the iron-III-complex of ethylenediamine tetra-acetic acid | 175 ml |
| | acetic acid (glacial acetic acid) | 10.5 ml |
| | sodium nitrate | 35 g |
| | water to make up to | 1 liter |
| 3. | Washing | 3 ¼ minutes |
| 4. | Fixing | 6 ½ minutes |
| | fixing bath: | |
| | ammonium thiosulphate (50% aqueous) | 16.2 ml |
| | diethylenetriaminepenta-acetic acid | 1.25 g |
| | sodium metabisulphite (anhydrous) | 12.4 g |
| | sodium hydroxide | 2.4 g |
| | water to make up to | 1 liter |
| 5. | Washing | 3 ½ minutes |
| 6. | Stabilizing | |
| | stabilizer bath: | |
| | formaldehyde (35% aqueous solution) | 5.0 ml |
| | water to make up to | 1 liter |

The sensitometric properties of the processed film wedges were determined using a scanning densitometer calibrated to match the response of black and white printing paper.

| Results | Fog | Log speed | Contrast |
|---|---|---|---|
| Assembly A [containing active cyan coupler (III)] | 0.01 | 10 | 0.75 |
| Assembly B [without active cyan coupler (III)] | 0.19 | 10.8 | 0.65 |

The table shows a large reduction in printing fog and an advantageous increase in printing contrast, with only slight reduction in foot speed when using the photographic material of the present invention.

TEST FOR COUPLER ACTIVITY

A mixture of oil-dispersed yellow-forming couplers (I) and (V) is prepared in the ratio 25:1.5 by weight respectively. To 26.5 mg aliquots are added 11 mg aliquots of test coupler. A reference sample is prepared by adding 11 mg of less reactive cyan coupler (IV) to a 26.5 ml aliquot of (I) and (V).

Each mixture is dispersed in 65 mg of silver as silver halide emulsion from Example 1 and coated on a 1 $dm^2$ glass plate.

The plates are exposed to a wedge, a colour processed in the usual way and the blue densities determined using a densitometer which is insensitive to red light. Preferred active couplers are those which give a reduction in yellow fog of at least 50%. In the results below cyan coupler (VI) is more active than the control, but gives insufficient density reduction. The mixture containing coupler (III) shows it to be more active and of the preferred type for this invention.

| Coupler mixture | Fog | D-max |
|---|---|---|
| [(I) + (V)] only Control | 0.43 | 2.05 |
| [(I) + (V)]+ (IV) | 0.40 | 2.11 |
| [(I) + (V)]+ (VI) | 0.30 | 1.82 |
| [(I) + (V)]+ (III) | 0.15 | 1.79 |

We claim:

1. Photographic silver halide material for preparing a monochromatic dye image by a chromogenic process which material comprises in at least one silver halide emulsion layer a colour coupler which couples with oxidized colour developer of aromatic primary amino type to produce a yellowish dye which absorbs light in the region of from 350 to 560 nm, a more reactive coupler compound which reacts with oxidized colour developer of the primary amino type to yield a dye of which the absorption is predominantly above 560 nm, and optionally further colour couplers, the ratio of coupler which produces a yellowish dye to more reactive coupler being from 10:0.1 to 10:2.0, the parts being by weight.

2. Photographic material according to claim 1, wherein at least 90% of the absorption of the dye produced by reaction of the more reactive coupler compound and oxidized colour developer is above 560 nm.

3. Photographic material according to claim 2, wherein the dye absorbs in the region of from 620 to 690 nm.

4. Photographic material according to claim 1, wherein the more reactive coupler compound is an active cyan colour coupler.

5. Photographic material according to claim 4, wherein the active cyan colour coupler is a cyan coupler of the general formula

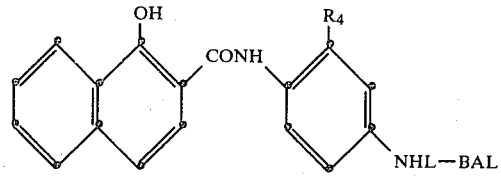

wherein $R_4$ is hydrogen, halogen or alkoxy, L is a linking group and BAL represents a ballasting group.

6. Photographic material according to claim 5, wherein $R_4$ is hydrogen, chlorine, bromine, methoxy or ethoxy, the linking group L is a grouping of the formula —CO—$CHR_{12}$—, wherein $R_{12}$ is hydrogen or lower alkyl, and the ballasting group is a dialkyl phenoxy radical wherein the alkyl groups contain at least 5 carbon atoms.

7. Photograhic material according to claim 1, wherein the colour coupler which couples with oxidized colour developer of aromatic primary amino type to produce a yellowish dye is a pivalyl acetanilide yellow colour coupler of the general formula

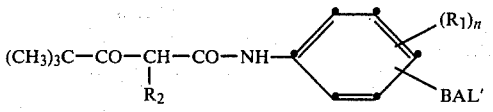

or a benzoyl acetanilide yellow colour coupler of the general formula

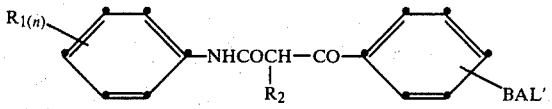

wherein $R_1$ is a substituent and n is 0, 1 or 2, $R_2$ is hydrogen or a leaving group and BAL' represents a ballasting group attached to a —NHCO—$(CH_2)_m$— grouping to make the coupler substantive to the layer in which it was coated, wherein m is an integer of from 1 to 5.

8. Photographic material according to claim 7, wherein $R_1$ is lower alkyl or alkoxy having 1 to 4 carbon atoms or halogen, and $R_2$, BAL' and n have the meanings assigned to them in claim 7.

9. Photographic material according to claim 1, which also comprises in at least one silver halide layer a further coupler or a mixture of couplers.

10. Photographic material according to claim 9, wherein the further coupler(s) produce with the yellowish colour coupler either a green or brown final image.

11. Photographic material according to claim 10, wherein the further coupler is a less reactive cyan colour coupler.

12. Photographic material according to claim 11, wherein the less reactive cyan colour coupler on coupling with the oxidized colour developer yields a dye whose maximum absorption is below 700 nm.

13. Photographic material according to claim 12, wherein the less reactive cyan colour coupler is a phenolic cyan colour coupler of the general formula

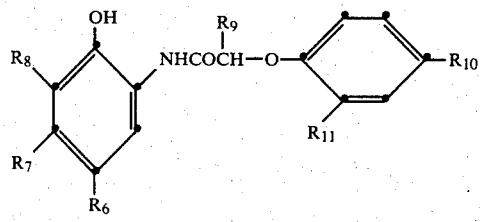

wherein $R_6$ is hydrogen or halogen, $R_7$ and $R_8$ are each hydrogen, or halogen or alkyl having from 1 to 4 carbon atoms, $R_9$ is hydrogen or alkyl having from 1 to 4 carbon atoms and $R_{10}$ to $R_{11}$ are each alkyl having from 5 to 10 carbon atoms.

14. Photographic material according to claim 1, wherein 10 parts yellowish colour couplers, from 0.1 to 2.0 parts active cyan colour coupler and from 2 to 4 parts less reactive cyan colour coupler are present.

15. Photographic material according to claim 14, wherein a green final image is produced.

16. Photographic material according to claim 9, wherein the additional colour coupler is a magenta colour coupler.

17. Photographic material according to claim 16, wherein the additional magenta colour coupler is a compound of the general formulae

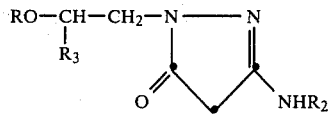

or

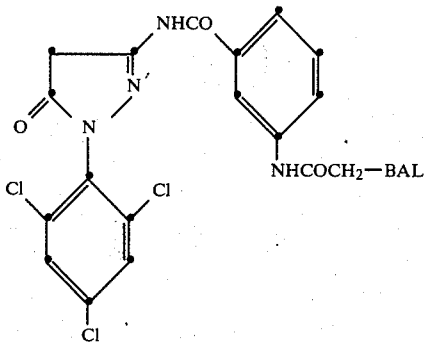

wherein R is hydrogen or a carboxylic acyl group of the formula R'—CO—, wherein R' is alkyl having 1 to 4 carbon atoms, $R_2$ is a carboxylic acyl group of the same formula, $R_3$ is hydrogen, alkyl having 1 to 4 carbon atoms, phenyl or substituted phenyl and BAL is a dialkylphenoxy radical, each of the alkyl groups having at least 5 carbon atoms.

18. Photographic material according to claim 1, wherein 10 parts yellowish coupler, from 0.1 to 2.0 parts active cyan colour coupler, from 2 to 4 parts less reactive cyan colour coupler and from 2 to 4 parts magenta colour coupler are present.

19. Photographic material according to claim 18, wherein a brown final image is produced.

20. Photographic material according to claim 9, wherein the further additional colour coupler is a DIR coupler.

21. Photographic material according to claim 20, wherein the DIR coupler is a yellow DIR coupler.

22. Photographic material according to claim 21, wherein the yellow DIR coupler is a colour coupler of the general formulae

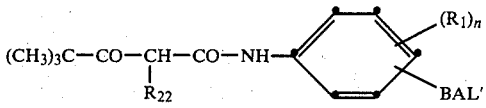

or

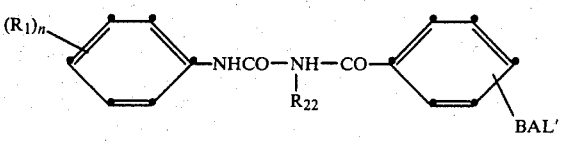

wheren $R_1$ is a substituent, n is 0, 1 or 2, $R_{22}$ is a DI compound and BAL' represents a ballasting group attached to a —NHCO$(CH_2)_m$-grouping to make the coupler substantive to the layer in which it was coated, wherein m is an integer of from 1 to 5.

23. Photographic material according to claim 22, wherein the DI compound is an alkylthiotriazolyl group, a mercapto group, a mercaptotetrazole or a benztriazole group.

24. Photographic material according to claim 23, wherein the DI compound is a compound of the formulae

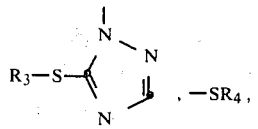

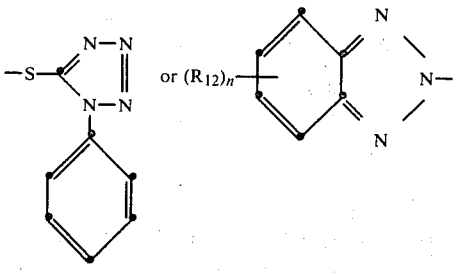

wherein $R_3$ is alkyl having from 4 to 8 carbon atoms, $R_4$ is alkyl having from 4 to 8 carbon atoms, phenyl or naphthyl, n is 1 to 3, $R_{12}$ is hydrogen or alkyl having 1 to 4 carbon atoms.

25. Photographic material according to claim 1, wherein 10 parts yellowish coupler, 0.5 to 1.5 parts active cyan colour coupler, 2 to 4 parts less reactive cyan colour coupler, 2 to 4 parts magenta colour coupler and 0.1 to 1.0, preferably 0.1 to 0.4 parts yellow DIR colour coupler are present.

26. Photographic material according to the claim 25, wherein the yellowish coupler is a pivaloyl coupler of the formula

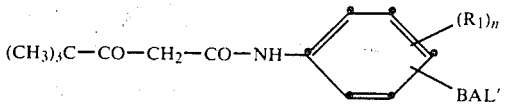

and the DIR coupler is a pivaloyl coupler of the formula

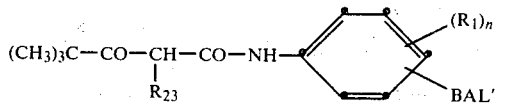

wherein $R_1$ is a substituent, n is 0, 1 or 2 and BAL' is a ballasting group attached to a $—NHCO(CH_2)_m$-grouping to make the coupler substantive to the layer in which it was coated, wherein m is an integer of from 1 to 5 and $R_{23}$ is an alkylthiotetrazole or 1-phenyl-5-mercaptotetrazole.

27. Photographic material according to claim 1, which comprises two silver halide emulsion layers each of which layers contains the yellow colour coupler and the more reactive coupler and optionally the other colour coupler as set forth in claim 11.

28. Photographic material according to claim 1, wherein all the coulour couplers are present in the silver halide emulsion layer(s) as an oil dispersion.

29. Photographic material according to claim 27, wherein the top emulsion layer in the assembly is a high speed silver halide emulsion and the lower emulsion layer is a low speed silver halide emulsion.

30. A process for the preparation of a monochromatic dye image which comprises imagewise exposing the photographic silver halide material as claimed in claim 1, colour developing the exposed material using a colour developing solution which comprises an aromatic primary amino colour developing agent, bleaching the thus formed silver image to yield a monochromatic dye image.

31. A process according to claim 30, wherein the aromatic primary amino colour developing agent is a para-phenylene diamine colour developing agent.

* * * * *